US005391016A

United States Patent [19]

Ivey et al.

[11] Patent Number: 5,391,016

[45] Date of Patent: Feb. 21, 1995

[54] METAL BEAM RAIL TERMINAL

[75] Inventors: Don L. Ivey, Bryan; Carl E. Buth, Wellborn; King K. Mak, San Antonio; Dean Sicking, College Station, all of Tex.

[73] Assignee: The Texas A&M University System, College Station, Tex.

[21] Appl. No.: 928,270

[22] Filed: Aug. 11, 1992

[51] Int. Cl.[6] ..... E01F 13/00

[52] U.S. Cl. ..... 404/6; 404/11; 403/377; 403/383; 403/DIG. 3; 256/13.1

[58] Field of Search ..... 404/6, 9, 10, 11; 403/377, 404, 383, 41, 2, DIG. 3, 179, 265; 256/13.1, 1, 19

[56] References Cited

U.S. PATENT DOCUMENTS

| | | | |
|---|---|---|---|
| 1,449,518 | 3/1923 | Lawson | 404/6 X |
| 2,826,393 | 3/1958 | Miller | 256/13.1 X |
| 2,927,513 | 3/1960 | Dove | 256/13.1 |
| 3,332,666 | 7/1967 | Gray | 404/6 X |
| 3,603,562 | 9/1971 | Glaesener | 256/13.1 |
| 3,690,619 | 9/1972 | Kendall | 256/13.1 |
| 3,704,861 | 12/1972 | Glaesener | 256/13.1 |
| 3,963,218 | 6/1976 | Glaesener | 404/6 X |
| 4,000,882 | 1/1977 | Penton | 404/6 X |
| 4,583,716 | 4/1986 | Stephens et al. . | |
| 4,607,824 | 8/1986 | Krage et al. . | |
| 4,655,434 | 4/1987 | Bronstad . | |
| 4,815,565 | 3/1989 | Sicking et al. . | |
| 4,819,916 | 4/1989 | Wun-chung | 256/13.1 |
| 4,838,523 | 6/1989 | Humble et al . | 256/13.1 |
| 4,928,928 | 5/1990 | Buth et al. . | |
| 5,022,782 | 6/1991 | Gertz | 404/6 |
| 5,078,366 | 1/1992 | Sicking et al. | 404/6 X |
| 5,112,028 | 5/1992 | Laturner | 256/13.1 |

OTHER PUBLICATIONS

"Engineering Agreement for Development and Design" (No. 44756, 18 pgs.), Apr. 26, 1990 (see pp. 17–20).

*Primary Examiner*—Mark Rosenbaum
*Assistant Examiner*—Frances Han

[57] ABSTRACT

The invention features a new and improved safety treatment for rails, such as a highway guardrail or barrier, which through compression of elongated segments of a telescoping terminal dissipates energy from vehicle impacts approaching from substantially upstream of the rail and reduce the hazard of "spearing." The impact energy is resisted by frictional and, in preferred embodiments, mechanical compression by a smaller segment of a filler disposed within a larger segment. In some embodiments, the invention further provides a nose piece to further reduce the spearing effect.

20 Claims, 5 Drawing Sheets

FIG.5
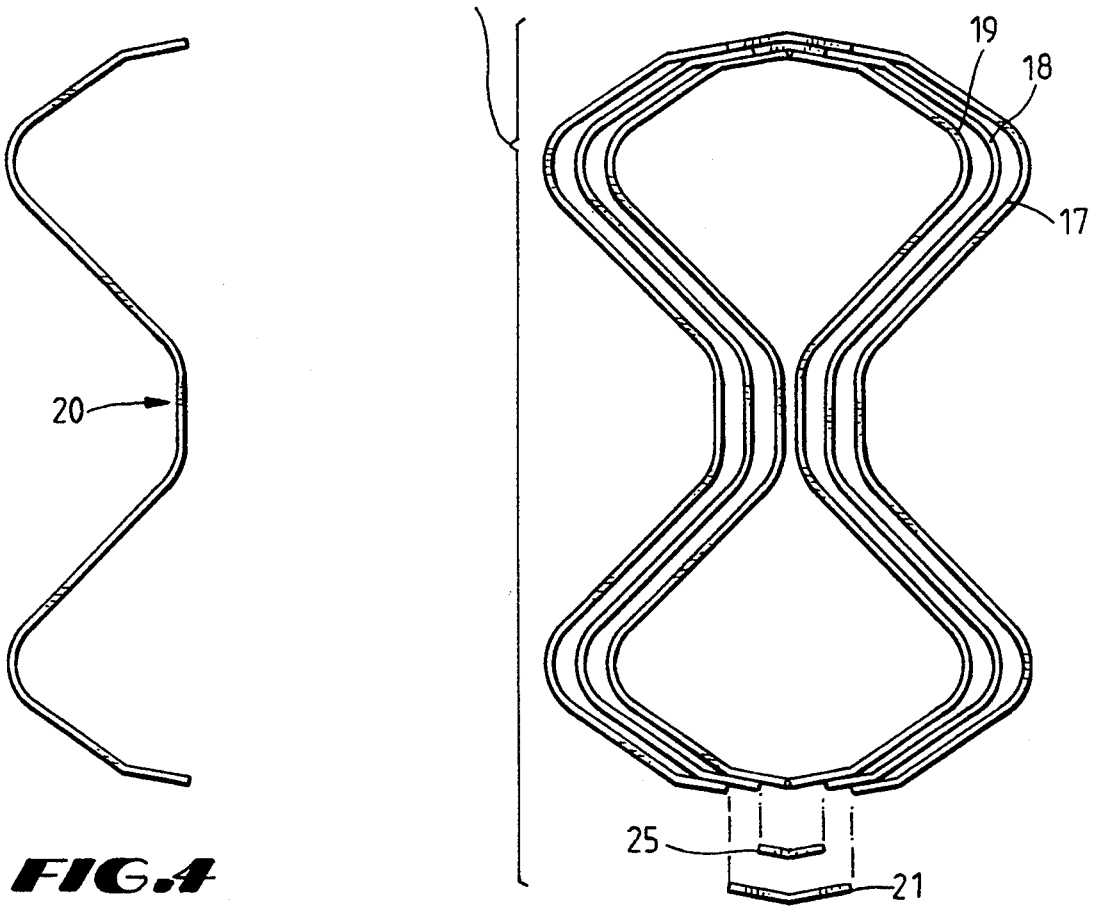
FIG.4
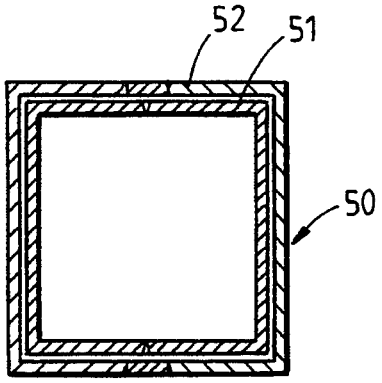
FIG.6

METAL BEAM RAIL TERMINAL

BACKGROUND OF THE INVENTION

1. Field of the Invention

The present invention generally relates to a safety treatment for the ends of metal beam guardrails. The invention more particularly relates to a mechanical energy absorbing system that is used as a terminal at the end of a metal beam guardrail, especially a box beam or W-beam guardrail.

2. Description of the Prior Art

Along most highways there are hazards that can be a substantial danger to drivers of automobiles which leave the highway. To help reduce such danger, guardrails have been provided. The guardrails are typically installed along roadsides or medians such that the upstream ends, or terminal ends of the guardrails facing the flow of traffic, do not in themselves form a hazard. Early guardrails lacked any special termination at the upstream ends, and occasionally impacting vehicles became impaled on the guardrails causing intense deceleration of the vehicle and severe injury to the occupants. In some reported cases, guardrails have actually penetrated directly into the occupant compartments of the vehicles with fatal results.

Upon recognition of the need for proper upstream guardrail termination, guardrail designs have been developed that use box beams and W-beams which allow tapering of the end of a guardrail into the ground, thereby providing a ramp and eliminating spearing effects. While these end treatments have successfully reduced the danger of a vehicle being penetrated in a head-on collision, it has been discovered that these end treatments tend to induce launching of a vehicle, causing it to become airborne for a considerable distance with the possibility of roll over.

In search for solutions to these problems, improved end treatments such as break away cable terminals (BCT), vehicle attenuating terminals (VAT), and the Sentre end treatment have been developed. All of these end treatments are designed to avoid the dangerous vaulting and roll over of vehicles. Thus, the BCT end treatment is designed to cause a W-beam guardrail to buckle out of the way of an impacting vehicle. However, since this design relies on dynamic buckling of the W-beam, it is sensitive to many installation details such as barrier flare rate and end off-set. Consequently, this design has not had a generally favorable service history.

The conventional BCT requires its W-Section to have the integrity and rigidity to redirect vehicles which impact downstream of the end. In order to maintain this beam and tension member strength, however, the resulting column strength is too large for small vehicles or those with notable soft zones in the front end unless a major eccentricity is built into the system as by flaring the end away from traffic. While such flaring has been advocated by the AASHTO 77 Barrier Guide it often has not been done in practice. It appears that this is one reason why many vehicles continue to be speared on BCT's every year.

The VAT safety treatment consists of overlapped guardrail sections that have a series of closely spaced slots. The guardrail segments are attached by bolts extending through the slots. When a vehicle impacts the end of this barrier, the bolts are forced to tear through the W-beam from one slot to the next. As a result, W-beam segments are cut into several long ribbons as an impacting vehicle is decelerated. Accordingly, the VAT safety treatment is, for all material purposes, a single-use system which has proven costly because of the need to replace the treatment after each collision.

The Sentre end treatment is constructed from a series of break away steel guardrail posts and fragile plastic containers. Impacting vehicles are decelerated as the guardrail posts are broken and as sand bags in the plastic containers are impacted. A cable is used to guide vehicles away from the guardrail during impact. This system is very expensive, and due at least in part to this expense, has not gained wide acceptance.

There is therefore a continuing need for an inexpensive, reusable end treatment which can be used at the end of a guardrail as a means of attenuating head-on impacts, and which will maintain structural integrity during impacts to longitudinal sides of the barrier. It is also desirable that such an end treatment be easily installed as an original installation or as a retrofit for existing terminals of other designs. It should also be easily serviced and inexpensive to manufacture.

SUMMARY OF THE INVENTION

Briefly, the present invention is directed to a new and improved safety treatment for rails such as highway guardrails or bridgerails. The safety treatment in a general aspect comprises a rail terminal that dissipates impact energy through compression of elongated segments of the rail terminal. More specifically, the rail terminal attacks the spearing problem by reducing or destroying the integrity of the rail and replacing the standard rail's moment and tensile capacity with a telescoping terminal that shortens at appropriate force levels when struck substantially from the upstream end. The terminal also provides the strength necessary to redirect the impacting vehicle if the collision occurs along the side of the terminal.

The telescoping terminal comprises a plurality of elongated segments which nest within each other and which may be compressed to slide within one another. In alternative exemplary embodiments, the segments comprise pairs of mutually opposed W-beam or box beam rail members, members of adjacent pairs being spaced from each other as needed to accommodate the neighboring pair or segment in a nesting relation. Nesting is achieved by slidingly disposing the sealed or closed end of at least one segment within the open end of its adjacent segment. In a preferred form, the segments or sets of pairs resemble lengths of tubing which are capable of compressing or telescoping one within another.

Compression of the segments provides frictional resistance against a force, such as an impacting vehicle, which attempts to compress the segments within each other. Such resistance may be further assisted by the addition of a filler, preferably a crushable material, within one or more of the segments, which may be mechanically crushed during the compression process.

A support post connection arrangement is employed which enables a segment of a rail treatment to be readily disengaged from fixed connection with support posts and to be moved in sliding relation to the support post to permit said segment to telescope upon an adjoining segment. Additionally, the rail terminal may comprise a nose piece to further cushion a vehicular impact.

BRIEF DESCRIPTION OF THE DRAWINGS

Further details are explained below with the help of the examples illustrated in the attached drawings in which:

FIG. 4 is a cross-sectional view taken from one end of an exemplary W-beam guardrail member used in accordance with the present invention.

FIG. 5 is a partially exploded cross-sectional view taken from one end of three pairs of W-beam rails wherein the individual pairs are joined together to form tubular-like segments capable of nesting.

FIG. 6 is a cross-sectional illustration of an alternative embodiment of the terminal of the present invention featuring a box beam type rail.

DETAILED DESCRIPTION OF THE PREFERRED EMBODIMENTS

Figure 1:
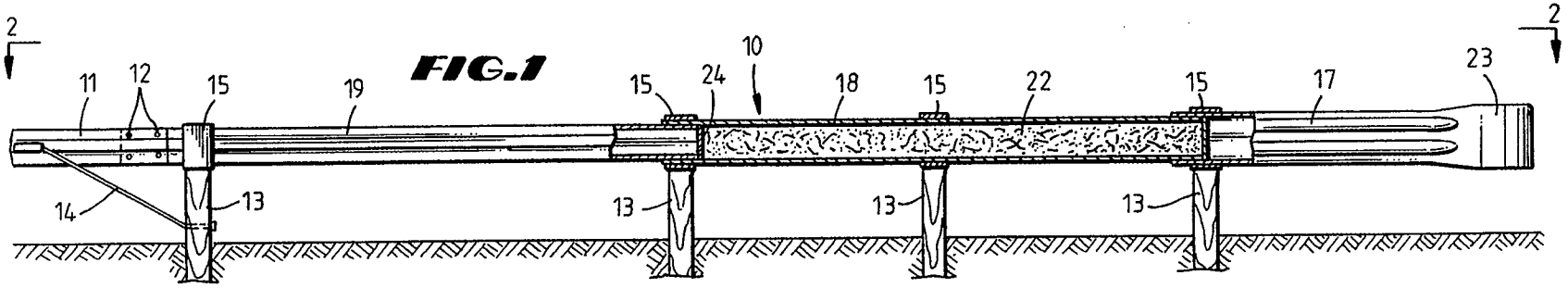
FIG. 1 is a partially cutaway side view of a preferred embodiment of a rail terminal of the present invention.

The concept of the invention is largely described through discussion of two preferred and exemplary terminals. Each of these embodiments contemplates the use of commonly available guardrail construction materials.

A first preferred embodiment of the invention is depicted in FIGS. 1–5. As shown here, the rail terminal comprises a telescoping terminal 10 which is fitted on the upstream end of a standard rail 11 such as a highway guardrail or bridgerail. Typically, rails such as rail 11 are made of W-shaped metal members. Terminal 10 may be attached to rail 11 by means of bolts, rivets or similar connectors 12. Those skilled in the art will recognize that terminal 10 may also be attached by welding or other means known in the art. Terminal 10 and rail 11 are supported from the ground by support posts 13. Rail 11 may be further attached to one or more support posts 13 by tension cable 14.

Figure 2:
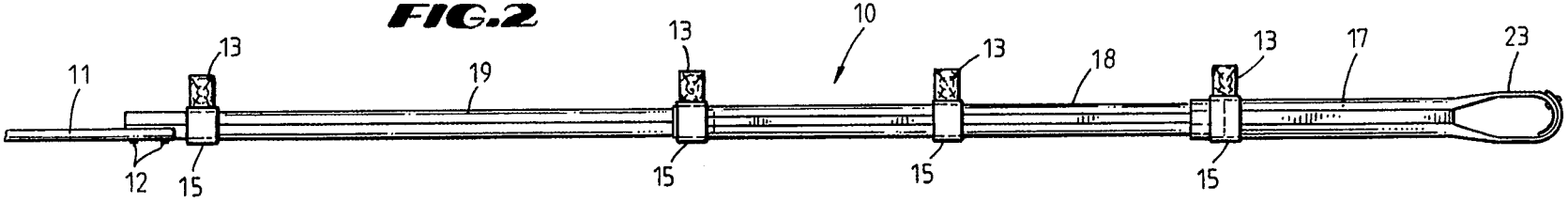
FIG. 2 is a top view of the embodiment of FIG. 1.
Figure 3:
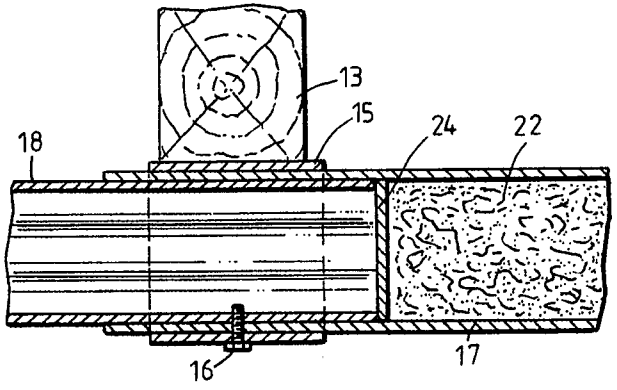
FIG. 3 is a top view detail in segment of a telescoped portion of the embodiment of FIGS. 1 and 2.

Terminal 10 is associated with support posts 13 in a sliding relation such that the terminal will collapse in upon itself, as described below, when struck on or near its upstream end while allowing the terminal to maintain its rigidity when struck predominantly from the side. FIGS. 1, 2, and 3 show an exemplary version of this association wherein a collar 15, fixedly attached to a support post 13, surrounds terminal 10 so as to permit sliding movement of portions of terminal 10 through collar 15 along the longitudinal axis of terminal 10. FIG. 3 shows that collar 15 may be connected to terminal 10 by means of shear pins 16. Suggested compositions for the shear pins include plastic, wood and light brittle metals.

Terminal 10, itself, comprises an assembly of a plurality of elongated segments 17, 18, and 19 which nest within one another to permit the terminal to collapse or telescope in upon itself. Although three nested segments are described in this exemplary embodiment, those skilled in the art will recognize that the number of segments may vary from two to four or more. Nesting is accomplished by sliding an inner segment having a smaller cross-section within an adjacent outer segment having a larger cross-sectional construction. The segments themselves, in a refined embodiment, comprise pairs of mutually opposed W-beam rail members 20, assembled as depicted in FIG. 5. Each segment or pair of members is joined or fixed in spaced relation as needed from each other to accommodate, or be accommodated by, an adjacent segment. Thus, the rail members in an outer segment are fixed in a spaced relation which is greater than for an inner segment so as to permit a telescoping of the two segments.

FIG. 5 shows, in cross-section, a particularly preferred configuration for constructing three segments in a nesting relationship. As shown, each pair of mutually opposed members 20 is laterally joined so as to form a separate segment. The actual joining may be by welding, brazing or other suitable joining method. Larger segments 17 and 18, are created by placing spacers 21 and 25, respectively, between mutually opposed members 20. In one preferred configuration, the spacers comprise bent plates of metal whose placement helps ensure that the rail members forming a larger segment are spaced sufficiently along their length to admit disposition of a smaller, adjacent segment. An exemplary suitable spacing arrangement between members lies in the use of 2 inch increments. In other words, the spacers for segment 18 are chosen to permit about 2" of separation between its members so as to permit entry of segment 19. Similarly, the spacers for segment 17 are chosen to permit about 4" of separation between its members so as to permit entry of segment 18.

Telescoping terminal 10 should preferably provide for each segment which is slidingly disposed within an adjacent, larger segment to have a closed or sealed inserted end. The end may be closed by welding or otherwise affixing a plate or cap 24 over the end of the smaller segment. A seal, such as an O-ring or other elastomeric seal, may additionally be affixed around the closed end or along the length of an internally disposed segment to improve the pneumatic conditions as well as the frictional resistance provided by the nested segments.

Alternative embodiments of the apparatus feature improved resistance as a collision progresses by use of a filler 22 within one or more larger segments to impede movement of the smaller segment within the larger segment. The filler 22 in terminal 10, for example, may comprise a crushable material such as styrofoam "peanuts," perlite or perlite concrete. The filler may be disposed throughout the segment as shown in FIG. 1 or placed in traps at points along the length of the larger segment.

It is strongly preferred that the upstream end of the upstream segment of terminal 10 be provided with a nose piece 23 to minimize initial impact and further reduce the spearing hazard. In a preferred configuration exemplified in FIGS. 1 and 2, nose piece 23 comprises a curled or curved portion of flattened guardrail section similar to that employed in a standard "Michigan end shoe." In other configurations, nose piece 23 may comprise a compressible air or fluid filled container with a broad backing affixed to the end of telescoping terminal 10.

In the event of a collision from substantially the upstream end (i.e., the end which includes nose piece 23) of the terminal, terminal 10 telescopes inward so as to collapse or shorten as the nested segments are forced further within each other. The force of the collision is resisted by friction between the segments. In refined embodiments, the collision force is further resisted by filler which impedes the path of the closed end of a smaller segment along the interior length of an adjoining larger segment. In turn, the filler is mechanically compressed by the closed end of the smaller segment.

The employment of collar 15 and shear pin 16 as an arrangement for attachment to segments of terminal 10 enables the segments to be readily disengaged from fixed attachment to the support posts and moved in sliding axial relation thereto. A segment may thus be axially compressed relative to an adjoining segment to permit telescoping upon application of an appropriate degree of lateral force to the segment originally held by the post attachment pin. Such an arrangement is depicted in FIG. 3 wherein post attachment pin 16 may be snapped by the axial motion of segment 17. Support post 13 will continue to vertically support segment 17.

In the event of a collision occurring from a direction other than substantially upstream of the end of the terminal, such as from a longitudinal side, the corrugated nature of the W-beam members helps terminal 10 to maintain its lateral integrity. The nested arrangement of the segments also helps assure integrity between the segment connections during impact from the longitudinal side. As a result, the barrier retains its capacity to substantially redirect a vehicle impacting from the side of the terminal.

As those skilled in the art will appreciate, modifications as to the type and design of the particular guardrail segments used may be made within the spirit of the inventive concepts disclosed herein. FIGS. 6–9, for example, illustrate a second exemplary terminal 50 constructed in accordance with the present invention and embodied in a box beam type guardrail terminal. Terminal 50 comprises exemplary segments 51, 52, and 53 each of which is constructed of mutually opposed U-shaped beam members or box beam members and fixed in spaced relation from each other as needed to accommodate the neighboring segment in nesting. In this embodiment, exemplary segment 52 comprises an outer tube which is cross sectionally larger than either segment 51 or segment 53. In a test terminal, which recently proved highly successful in testing, segment 52 was 24 feet in length, 7 inches by 7 inches in outer cross-sectional dimensions, and formed of $\frac{1}{8}$ inch thick sheet metal. The mutually opposed box beam members forming the segment were laterally affixed by 3 inch long welds set 6 inches apart along the length of the segment. Segment 52 may be reinforced proximate its ends or along its length using collar 54 and longitudinal reinforcements 55. In the test terminal, longitudinal reinforcements 55 comprised 12 inch long parallel continuous welds.

Figure 7:
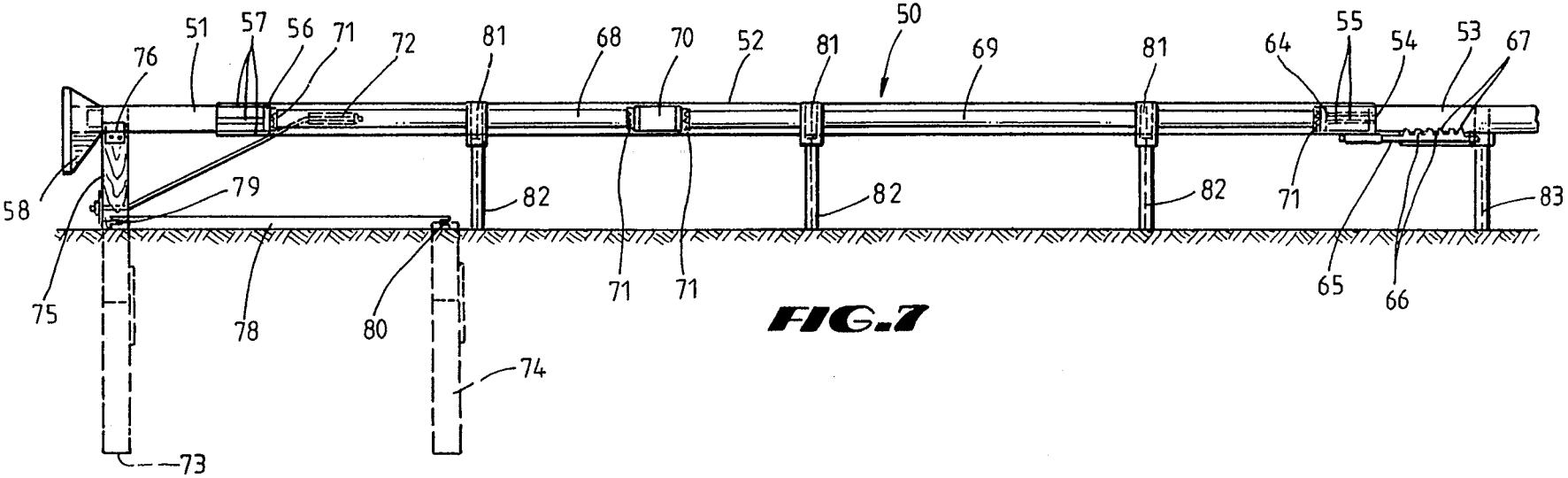
FIG. 7 is a side view in partial cutaway of an alternative embodiment of the terminal of the present invention featuring a box beam type rail.
Figure 8:
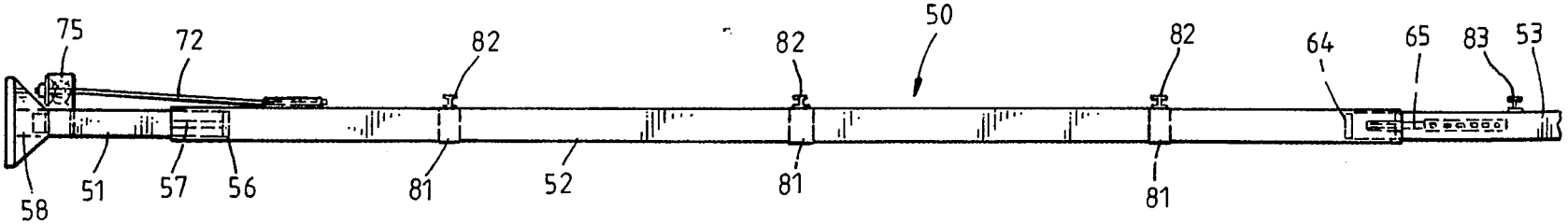
FIG. 8 is a top view in partial phantom of an alternative embodiment of the terminal of the present invention featuring a box beam type rail.
Figure 9:
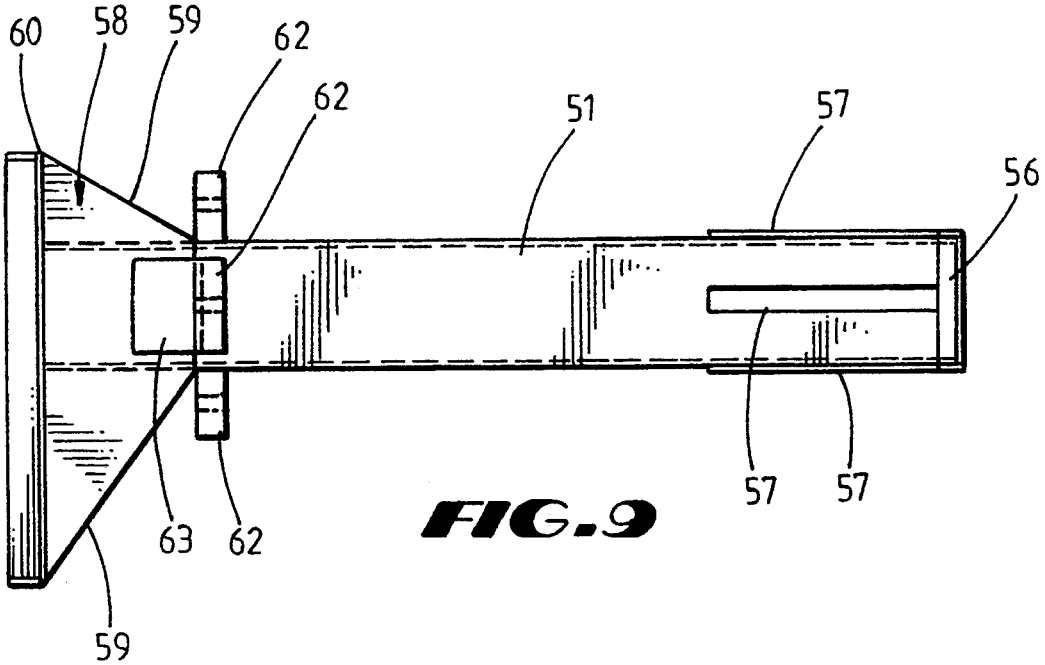
FIG. 9 is a detailed side view of the exemplary end piece shown in FIGS. 7 and 8.

Segment 51 nests within the upstream end of segment 52, as shown in FIGS. 7 and 8. In the test terminal, this segment was a 3 foot long, 6 inch by 6 inch box beam constructed of 3/16 inch steel. The downstream end of segment 51 includes end cap 56 which may be affixed to the end of segment 51 by means of welding. In the test terminal, the end cap 56 comprised a $\frac{1}{8}$ inch steel plate. Spacers 57 comprised one-inch wide $\frac{1}{4}$ inch steel straps welded longitudinally to the outside of segment 51. The width of the spacers 57 serve the function of creating a tighter fit between the outer surfaces of spacers 57 and the interior surfaces of segment 52.

Figure 10:
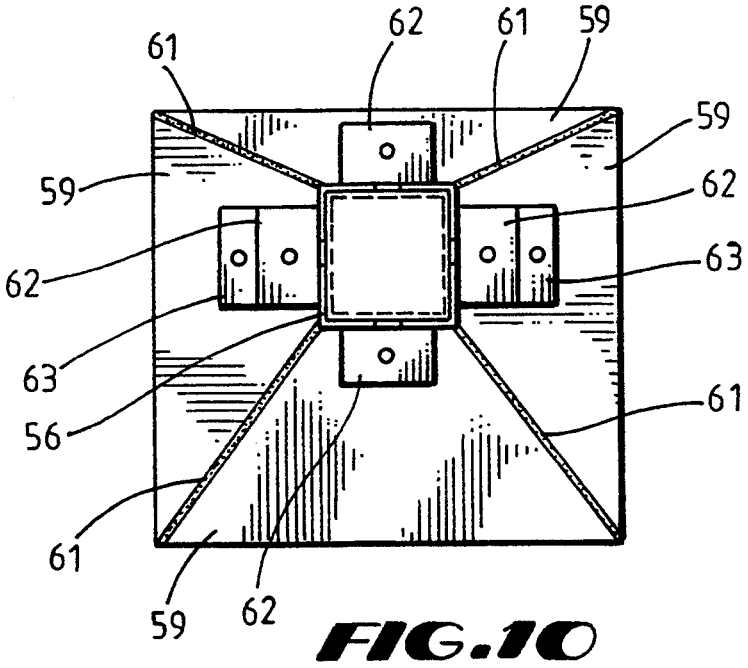
FIG. 10 is an end view of the exemplary end piece shown in FIG. 9.

The upstream end of segment 51 includes a nose piece 58. Exemplary nose piece 58, shown in detail in FIGS. 9 and 10, comprises an impact plate 60 which is fixedly attached, by welding or other suitable techniques, to the upstream end of segment 51 and supporting members 59 which support impact plate 60 in fixed attachment to the end of segment 51 at the upstream end of segment 51. In the test terminal discussed above, impact plate 60 comprised a 20 inch by 20 inch steel plate of $\frac{3}{8}$ inch thickness. Supporting members 59 comprised four $\frac{1}{2}$ inch thick steel gusset plates cut in suitable trapezoidal shapes and welded along the edge having the smallest side to the side of segment 51. The supporting members were welded along their opposite edges to the edges of impact plate 60. Additional strength was provided by welding the remaining edges of each supporting member to the adjoining edges of the neighboring supporting member as shown by weld points 61 in FIG. 10.

In some preferred embodiments, nose piece 58 includes bumpers 62 adapted to help absorb impacts with downstream portions of terminal 50 upon compression or telescoping inward of terminal 50. Bumper supports 63 fixedly hold said bumpers 62 in place. In the test terminal, bumpers 62 comprised four $1\frac{1}{2}$ inch thick rectangular rubber pads; bumper supports 63 comprised four L-shaped metal pieces such as sections of angle iron which are each securely affixed to a side of segment 51 by welding. Bumpers 62 are affixable to bumper supports 63 by nuts-and-bolts, screws, or other arrangements well known in the art.

Segment 53 nests within the downstream end of segment 52, as shown in FIGS. 7 and 8. This nesting arrangement is similar to that of segment 51 within the upstream end of segment 52. End cap 64 may be fixedly attached to the end of segment 53 in a manner similar to the attachment of end cap 56 to segment 51.

In some embodiments, such as that of the test terminal, the nesting relationship of segments 52 and 53 is supplemented by a breakaway tensile connector arrangement such as shown in FIGS. 7 and 8. An exemplary breakaway tensile connector arrangement comprises a tensile connector 65 of a strong rigid material which is partially fixedly attached to segment 52 proximate the downstream end of segment 52 while permitting a portion of the connector 65 to extend across the surface of segment 53. Such an arrangement is described in U.S. Pat. No. 4,929,928 issued to Buth et al. which is incorporated herein by reference. The tensile connector used with the test terminal discussed above comprised a six inch long 2"×2" tube of 3/16" steel. A portion of the tube was welded to the outer surface of segment 52 so that a portion of the tensile connector extended across the surface of segment 53. For the test terminal, this portion of tensile connector 65 comprised a $1\frac{1}{4}$ inch diameter thread rod and $16\frac{1}{2}$ inch long 3"×2" tube of 3/16" metal welded to the 6 inch long tube. The extended portion of tensile connector 65 is associated with segment 53 by means of teeth 66 which extend from tensile connector 65 and engage notches 67 in an arrangement similar to that described in Buth et al. Teeth 66 are preferably sloped or angled in an upstream direction to assist teeth 66 in engaging notches 67 as segment 52 is attempted to be withdrawn from the nesting arrangement with segment 53 and avoiding such engagement as an attempt is made to telescope segment 52 over 53 such that segment 53 is further disposed within segment 52.

Figure 11:
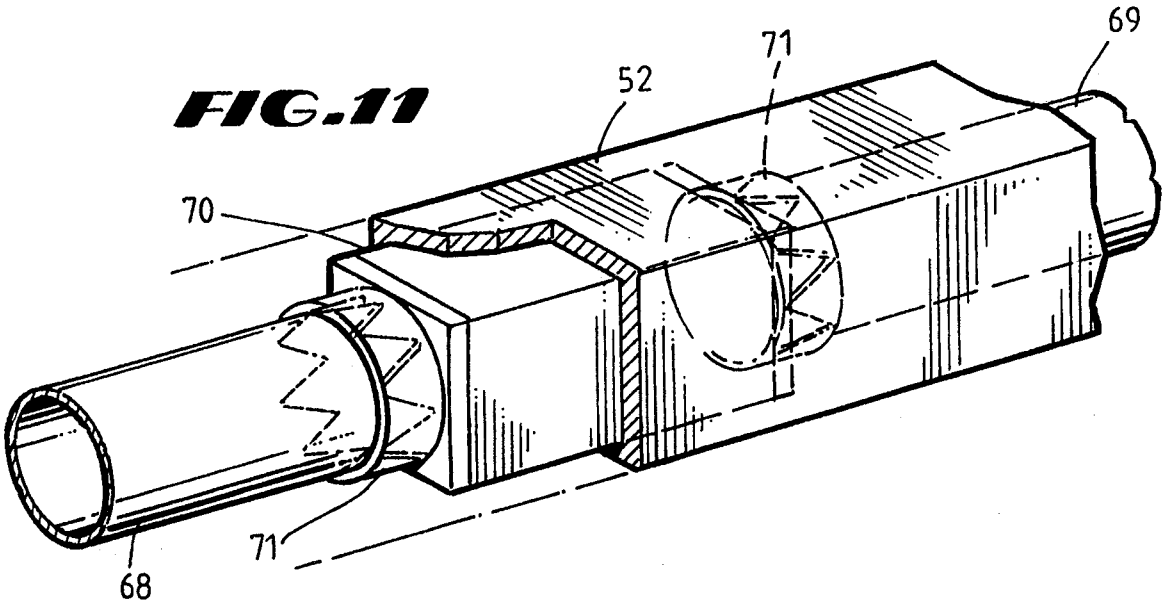
FIG. 11 is detailed cutaway view of an exemplary rail terminal segment containing two crushable tubular members and a spacing element.
Figure 12:
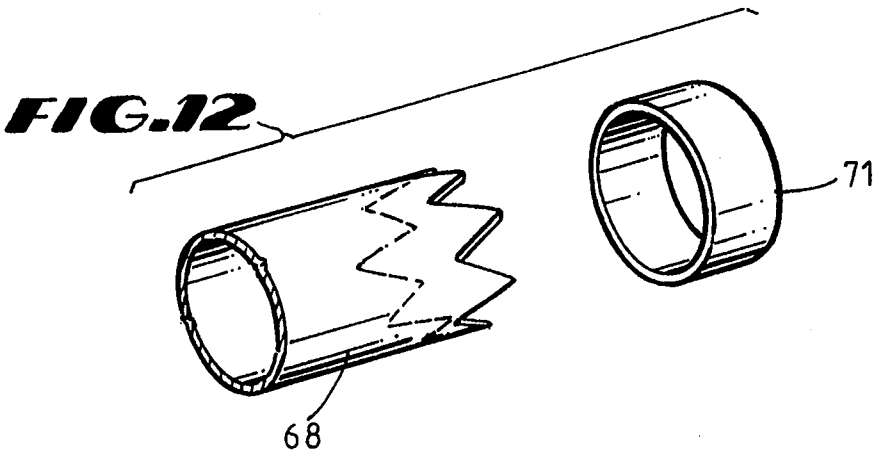
FIG. 12 is an exploded view of crushable tubular member with an end cap.

The crushable filler for terminal 50 comprises one or more tubular members shown best in FIGS. 11 and 12. In a preferred embodiment, the crushable filler comprises a first tubular member 68 and second tubular member 69 made of crushable material such as fiberglass and adapted to fit within the confines of the segment 52. One suitable commercially available tubular member is the Extren Series 500 Fiberglass Reinforcing Plastic Structural Shape available from Imco Reinforced Plastics, Inc., P.O. Box 534, 858 N. Lenola Road, Moorestown, N.J. 08057. It is preferred that the first tubular member 68 be adapted to crush more easily than the second tubular member 69. This may be accomplished by providing tubular members having different wall thicknesses. A suitable first tubular member has been found to be a tube of about six feet in length, 6 inches in diameter and having a $\frac{1}{8}$ inch wall thickness. A suitable second tubular member to date has been a tube of 12 feet, 8 inches with a six inch diameter and a $\frac{1}{4}$ inch wall thickness.

In a preferred embodiment of the terminal 50, a spacing element 70 is slidably disposed within segment 52 between the first tubular member 68 and the second tubular member 69. The spacing element must be shaped to be accommodated within the segment 52 and slide along its length. In the test terminal, the spacing element was constructed of a 10 inch long segment of $6'' \times 6'' \times 3/16''$ steel box beam with $\frac{1}{8}''$ steel plate pieces and $1'' \times \frac{1}{4}''$ steel straps welded to either end to present closed outer surfaces toward the tubular members 68 and 69 when the spacing element 70 is disposed within the segment 52.

The ends of the first and second tubular members 68 and 69 may be modified to assist crushing of the tubular members by notching the ends of these members so that the ends have a series of teeth. In the test terminal, the teeth of first tubular member 68 were approximately six inches in length and approximately four inches in length for second tubular member 69. The ends may be said to resemble a tulip shape as illustrated in FIGS. 11 and 12. The ends of each or either tubular member may be further fitted with end caps 71 to help ensure even distribution of the crush force over the total cross-section of the tubular member. End caps 71 in the test terminal were formed cylinders made of 16 gage sheet metal.

Terminal 50 also features a breakaway cable anchor 72 which permits the terminal to collapse upon an impact substantially from the end while helping to maintain anchorage for the terminal during impacts substantially from the side. The cable anchor arrangement is similar to that described in U.S. Pat. No. 4,928,928 issued to Buth et al. in which a breakaway cable anchor is releasably attached at one end to a portion of a terminal and attached at its other end proximate the base of an upstream support post. During a collision from a vehicle substantially from the upstream end of terminal 50, cable anchor 72 is released from its attachment with terminal 50.

The upstream portion of terminal 50 further comprises a tube and strut type anchorage system. This system enhances anchorage and the tensile capacity of the terminal to withstand impacts substantially from the side of the terminal.

The tube and strut arrangement comprises first and second foundation tubes 73 and 74, respectively. These tubes should be hollow and set into the ground so as to permit a post or other anchor member to be disposed within. Preferably, foundation tubes 73 and 74 should both be set into the ground such that the top of each tube is relatively flush with the ground line. In the test terminal, the foundation tubes were rectangular tubes formed of 3/16" sheet metal and a $6'' \times 8''$ cross segment. Breakaway post 75 is adapted to be disposed within first foundation tube 73 and support a portion of segment 51. Preferably, breakaway post 75 comprises a section of wood or similar material such as a section of nominally dimensioned $6'' \times 8''$ timber which is frangible and may be broken away or substantially destroyed at the onset of a vehicle impact. As may be seen in FIG. 7, the lower portion of breakaway post 75 is disposed within first foundation tube 73 while the upper portion of the post supports segment 51 proximate its upstream end. The upper portion of post 75 preferably supports segment 51 using a collar or shelf means 76 which may comprise a section of angle iron or similar device which may be fixedly attached to post 75 by means of bolts, screws or similar means and provides a surface upon which segment 51 may rest. As shown by FIG. 7, a portion of second foundation tube 74 is disposed above the groundline.

Strut 78 is used to connect first and second foundation tubes 73 and 74 and, in one embodiment, comprises a length of wood, fiberglass or metal having a length necessary to span the horizontal distance from first foundation tube 73 and second foundation tube 74. Strut 78 is notched or slotted at each end such that the slot is capable of receiving the shaft of a pin or bolt.

The connections between strut 78, first and second foundation tubes 73 and 74 are completed with use of pins 79 and 80. Pin 79 is fixedly emplaced within first foundation tube 73 such that a portion of pin 79 extends from tube 73 and presents a portion of its shaft to engage a slot at one end of strut 78. Pin 79 is preferably emplaced within tube 73 such that pin 79 will extend from tube 73 at a point slightly above the groundline. The slotted ends of strut 78 engage pins 79 and 80.

Similarly, pin 80 is fixedly emplaced within second foundation tube 74 such that a portion of pin 80 extends from second foundation tube 74 and presents a portion of its shaft to engage a slot at one end of strut 78. Pin 80 is also preferably emplaced within second foundation tube 74 such that pin 80 will extend from second foundation tube 74 at a point slightly above the groundline. Strut 78 extends along the groundline between first and second foundation tubes 73 and 74 to transmit structural tensional forces from first tube 73 to second tube 74. Such forces may be expected to be exerted upon first tube 73 in the event of a collision from the side of terminal 50. The strut also assists the breakaway function of post 75 as it helps keep the base of post 75 from being removed from foundation tube 73 during a collision from the upstream end of terminal 50.

As best seen in FIG. 7, segment 52 is coupled by collars 81 to support posts 82. As with terminal 10, the collars 81 of terminal 50 couple the terminal to post 82 in a manner enabling segment 52 to move through said collars along the terminal's longitudinal axis. In the test terminal, collars 81 comprised $\frac{1}{8}''$ steel straps bent to fit around the exterior of segment 52 and bolted to posts 82.

Segment 53 is affixed to post 83 by means of bolts, screws, rivets, or similar means in a non-sliding relationship. The downstream portion of segment 53 (not shown) may be attached to a guardrail or road barrier just as terminal 10.

In operation, terminal 50 telescopes inward upon impact by a vehicle such that the impact is substantially resisted by both friction as the segments 51, 52 and 53 are telescoped in upon each other and the crushing of the tubular members 68 and 69 as telescoping occurs.

During the course of a collision, bumpers 62 act to cushion the impact between end piece 58 and the upstream portion of segment 52 to assist in limiting damage to both parts.

Tests of the test terminal were conducted in accordance with guidelines set forth in National Cooperative Highway Research Program Report 230 and used vehicle impacts directed from the upstream end of the terminal as well as from the terminal's side. During collisions in each case, occupant impact velocities and ridedown accelerations remained within recommended limits.

In one test, an 1,800-lb passenger car impacted the test terminal from the terminal's upstream end at a nominal impact speed of 60 mph. The impact crushed the entire length of the first tubular member 68 and approximately four inches of the length of second tubular member 69. The vehicle remained stable throughout the impact, finally yawed away from the end terminal and came to a controlled stop.

In a second test a 4,500-lb passenger car impacted the test terminal at the same angle and nearly identical speed to the 1,800-lb passenger car. In this test, the entire length of first tubular member 68 was crushed as well as about seven feet of the length of second tubular member 69. Again the impacting vehicle remained stable during the impact. Although the vehicle sustained severe damage, no intrusion or deformation of the passenger compartment of the vehicle occurred.

Two other tests were conducted in which the terminal was impacted from a longitudinal side. In the first test, an 1,800-lb passenger car collided with the side of the terminal at an angle of approximately 20 degrees and at a speed of approximately 60 mph. During impact, the vehicle remained stable and in contact with the barrier and was substantially redirected toward the roadway from which it had approached. The vehicle sustained moderate damage, but no intrusion or deformation of the vehicle's passenger compartment occurred.

In the second test, a 4,500-lb passenger car collided with the side of the terminal at an angle of approximately 25 degrees and at a speed of approximately 60 mph. During impact, the vehicle remained stable and in contact with the barrier and was substantially redirected toward the roadway from which it had approached. The vehicle sustained moderate damage, but no intrusion or deformation of the vehicle's passenger compartment occurred.

Various modifications and improvements may be made to the disclosed embodiments of the present invention without departing from the overall scope and spirit of the invention.

What is claimed is:

1. A terminal including a downstream end for attachment to a roadside or median guardrail or barrier, said terminal also including an upstream end to receive and attenuate vehicle impacts, said terminal comprising a telescoping assembly of nested, elongated tubular-like segments including an inner segment and a cross-sectionally larger outer segment that concentrically and telescopically receives and envelops the inner segment in response to pressure applied to the terminal's upstream end.

2. The terminal of claim 1, wherein at least one inner segment includes an end that is closed.

3. The terminal of claim 1, wherein the upstream end of the terminal is provided with a nose piece.

4. The terminal of claim 3, wherein the nose piece comprises a curved portion of flattened guardrail.

5. The terminal of claim 3, wherein the nosepiece comprises an impact plate with a substantially flat surface fixedly attached to the upstream end of the terminal, said nosepiece further including supporting members which support the impact plate in fixed attachment to said upstream end.

6. The terminal of claim 5 wherein said nose piece further comprises at least one bumper adapted to help absorb impacts of the nose piece with downstream portions of said terminal during a vehicle impact with said nose piece.

7. The terminal of claim 2, further comprising a crushable filler disposed within said larger segment and adapted to be mechanically compressed by said closed end upon inward telescoping of the closed end within the larger segment.

8. The terminal of claim 7, wherein the filler comprises a crushable tubular member.

9. The terminal of claim 8, wherein at least one end of said crushable tubular member is notched to define a series of teeth whose lengths are sized to facilitate crushing of the tubular member in response to longitudinal compression thereof.

10. The terminal of claim 8 wherein at least one end of at least one crushable tubular member is fitted with an end cap.

11. The terminal of claim 8, having two crushable tubular members and a spacing element slidably disposed between said crushable tubular members.

12. The terminal of claim 1, further including multiple support posts and a collar for each such support post to couple the terminal to said post by surrounding portions of the segments with the collars while enabling the segments to telescopically slide through the collars along the longitudinal axis of the segments.

13. The terminal of claim 12, including a shear pin adapted to attach each said collar to said terminal, said shear pin further adapted to shear upon movement of a segment through said collar.

14. The terminal of claim 12, wherein at least one of said support posts is frangible such that the post substantially breaks away during a vehicle impact.

15. The terminal of claim 14, wherein the upstream portion of said terminal includes a tube and strut anchorage comprising:

a. a first foundation tube adapted to be set into the ground;

b. a breakaway support post adapted to be disposed within said foundation tube and support a portion of said terminal;

c. a second foundation tube adapted to be set into the ground spaced along said assembly from said first foundation tube;

d. a strut extending along the groundline between said first foundation tube and said second foundation tube and adapted at its opposing ends to engage said first and second foundation tubes.

16. The terminal of claim 15, further comprising a breakaway cable anchor, said attached at one end to said frangible post and releasably attached at its other end to a portion of said terminal.

17. The terminal of claim 2, wherein an elongated segment comprises a pair of mutually opposing guardrail members laterally spaced as needed from each other to accommodate another segment in a nesting relationship, said members being joined to each other along their lengths to form said segment.

18. The terminal of claim 17, wherein the guardrail members comprise W-shaped guardrail members.

19. The terminal of claim 17, wherein the guardrail members comprise box beam members.

20. The terminal of claim 1, further comprising at least one additional elongated tubular-like segment cross-sectionally larger than the outer segment and telescopically connected thereto, to concentrically and telescopically receive and envelop the outer and inner segments in response to pressure applied to the terminal's upstream end.

* * * * *